United States Patent [19]

Cullen et al.

[11] Patent Number: 4,749,600

[45] Date of Patent: Jun. 7, 1988

[54] LIQUID ABSORBING AND IMMOBILIZING PACKET

[75] Inventors: John S. Cullen, Buffalo; Samuel A. Incorvia, Tonawanda, both of N.Y.; Willis B. Ryon, Vincentown, N.J.

[73] Assignee: Multiform Desiccants, Inc., Buffalo, N.Y.

[21] Appl. No.: 863,722

[22] Filed: May 16, 1986

[51] Int. Cl.[4] ..... B27N 5/02; B65D 81/26; B65D 85/84; A21D 10/02

[52] U.S. Cl. ..... 428/35; 428/200; 428/76; 428/201; 428/210; 206/204; 206/524.7; 426/124

[58] Field of Search ..... 428/35, 76, 200, 201, 428/210; 206/204, 524.7; 426/124

[56] References Cited

U.S. PATENT DOCUMENTS

| | | | |
|---|---|---|---|
| 2,283,867 | 5/1942 | Flasdorf et al. | 206/204 |
| 3,990,872 | 11/1976 | Cullen | 55/274 |
| 4,124,116 | 7/1978 | McCabe, Jr. | 206/204 |
| 4,603,069 | 7/1986 | Haq et al. | 428/76 |
| 4,615,923 | 10/1986 | Marx | 428/35 |

FOREIGN PATENT DOCUMENTS

| | | | |
|---|---|---|---|
| 1362935 | 7/1962 | France | 206/524.7 |
| 711186 | 6/1954 | United Kingdom | 206/204 |

*Primary Examiner*—John E. Kittle
*Assistant Examiner*—Patrick J. Ryan
*Attorney, Agent, or Firm*—Joseph P. Gastel

[57] ABSTRACT

A packet for absorbing and immobilizing a liquid including an envelope which is degradable in the liquid and a liquid absorbing and immobilizing material in the envelope.

17 Claims, 1 Drawing Sheet

LIQUID ABSORBING AND IMMOBILIZING PACKET

BACKGROUND OF THE INVENTION

The present invention relates to a packet of material for absorbing and immobilizing liquid after the liquid comes in contact therewith.

By way of background, the liquid absorbing and immobilizing character of sodium polyacrylate is known. A small amount of this material will absorb and immobilize a relatively large quantity of an aqueous solution by forming a gel-like material when it reacts therewith.

SUMMARY OF THE INVENTION

It is the object of the present invention to provide a packet for insertion between an outer container and an inner container of liquid for absorbing and immobilizing liquid which may spill from the inner container, thereby tending to prevent leakage through the outer container. Other objects and attendant advantages of the present invention readily will be perceived hereafter.

The present invention relates to a packet for absorbing and immobilizing a liquid comprising an envelope which is degradable in said liquid, and a liquid absorbing and immobilizing material in said envelope.

The present invention also relates to an absorbent packet for use with an outer container having an inner container with liquid from which said liquid can leak, the absorbent packet being located between said inner and outer containers for absorbing and immobilizing said liquid within said outer container in the event of leakage of said liquid from said inner container comprising an envelope which is degradable in said liquid, and a liquid absorbing and immobilizing material in said envelope.

The various aspects of the present invention will be more fully understood when the following portions of the specification are read in conjunction with the accompanying drawings wherein:

DESCRIPTION OF THE PREFERRED EMBODIMENTS

Figure 1:
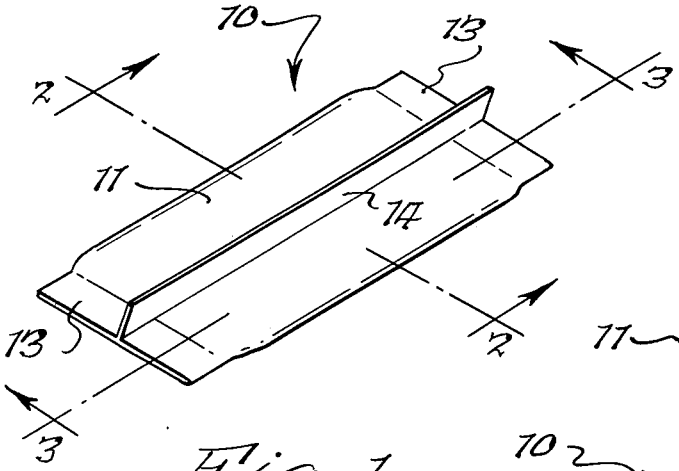
FIG. 1 is a perspective view of the absorbent packet of the present invention.
Figure 2:
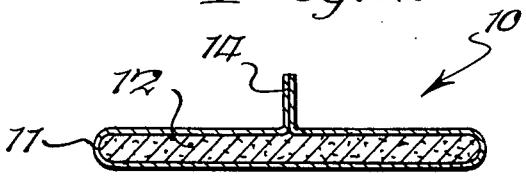
FIG. 2 is a cross sectional view taken substantially along line 2—2 of FIG. 1.
Figure 3:
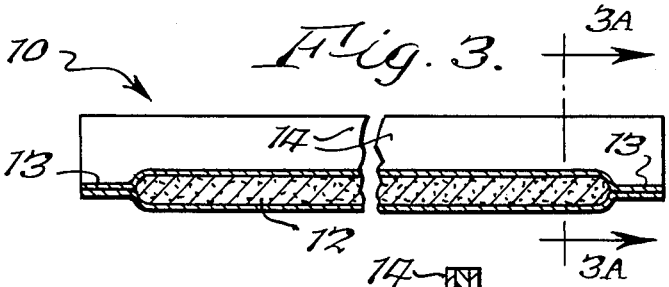
FIG. 3 is a fragmentary cross sectional view taken subtantially along line 3—3 of FIG. 1.
Figure 4:
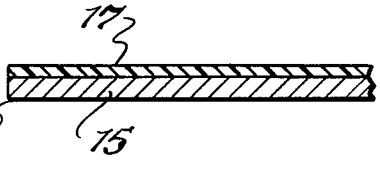
FIG. 4 is a fragmentary enlarged cross sectional view of the material which comprises the envelope.
Figure 3A:
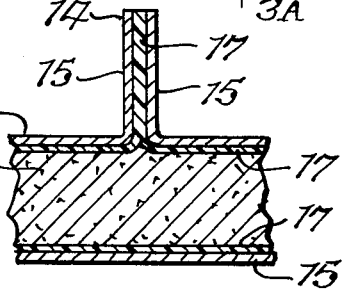
FIG. 3A is a fragmentary cross sectional view taken substantially along line 3A—3A of FIG. 3.

The packet 10 for absorbing and immobilizing a liquid includes an envelope 11 of material which is degradable in the liquid and a liquid absorbing and immobilizing material 12 contained within envelope 11. The envelope 11 is formed of sheet material which is heat-sealed at end seams 13 and along a central seam 14. Preferably the sheet material from which envelope 11 is made includes a degradable starch paper 15 having a polyvinyl acetate coating 17 over its entire surface. When the envelope 11 is fabricated, the starch paper 15 is the outer layer and the polyvinyl acetate coating is the inner layer. It is the polyvinyl acetate coating portions of envelope 11, when placed face-to-face which permits the seams 13 and 14 to be formed by heat-sealing, as depicted in FIG. 3A.

In the present instance the degradable outer layer 15 of envelope 11 is a starch paper which is degradable in water. However, the envelope may be of any other liquid-degradable material. The liquid absorbing and immobilizing material 12 is sodium polyacrylate having the formula $(C_3H_3O_2Na)_n$. It is obtainable under the trademark WATER LOCK J-550 from Grain Processing Corporation. This material is a free-flowing powder having the ability to absorb or immobilize large volumes of aqueous solutions including dilute alkalis, dilute acids and body fluids. The material 12 will absorb and immobilize 650 milliliters of water per gram of material or 75 milliliters of 1% sodium chloride solution per gram of material. The material 12 will perform the foregoing absorbing and immobilizing in about 25 seconds and added to this is the time which is required for the envelope 11 to degrade which is about another 30 seconds. Thus, when the packet 10 is immersed in liquids of the foregoing type, the absorbing and immobilizing process will take approximately one minute.

Figure 5:
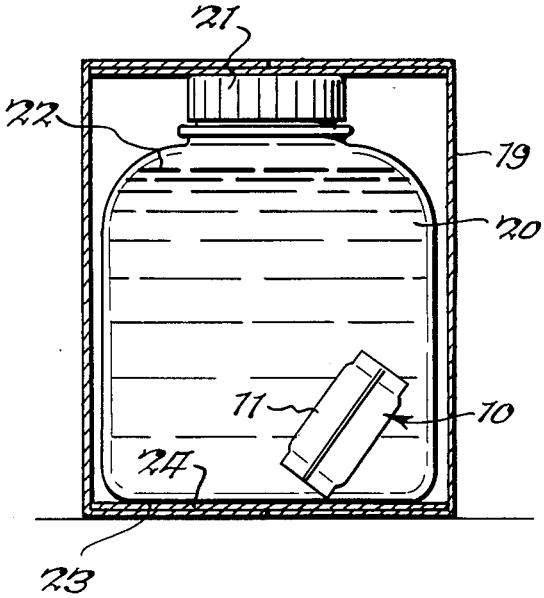
FIG. 5 is a side elevational view, partially in cross section, showing an inner container of liquid located within an outer container with the degradable packet of absorbing and immobilizing material located therebetween while the inner container is intact.
Figure 6:
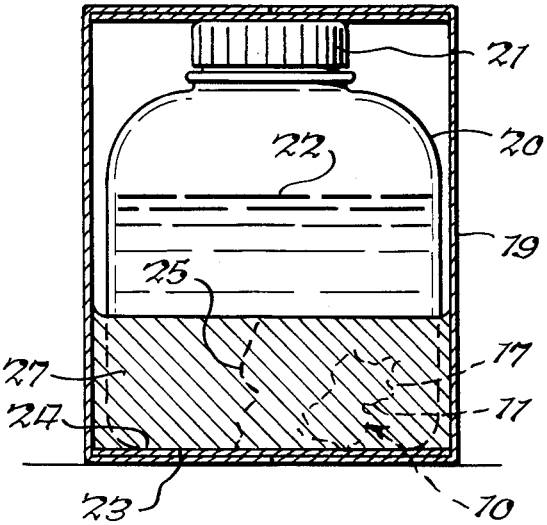
FIG. 6 is a view similar to FIG. 5 but showing a rupture in the inner container and the liquid which leaked therefrom solidified after the degrading of the packet envelope.

In FIGS. 5 and 6, one mode of operation of packet 10 is disclosed. In this instance, packet 10 is inserted into outer container 19, which may be of any suitable material, such as paper, cardboard, wood or plastic, and it is located outside of inner frangible container 20 which may be of any suitable material, such as glass, ceramic or plastic. Inner container 20 includes a cap 21 which holds the liquid 22 sealed within inner container 20. While packet 10 is shown located between the sides of containers 19 and 20, it is preferable that it be located between the bottom 23 of inner container 20 and the bottom 24 of outer container 19 so that if there is leakage, the envelope 11 will start to degrade at the earliest possible time. While outer container 19 is shown in cross section in FIGS. 5 and 6, it will be appreciated that it completely surrounds inner container 20 to the extent that it will tend to capture any liquid which leaks from the inner container.

If for any reason inner container 20 should rupture, as by a crack 25 (FIG. 6) so that liquid 22 will flow therethrough, the envelope 11 of packet 10 will start to degrade upon contact with the liquid. After it has degraded sufficiently, the material 12 will react with the liquid to absorb and immobilize it by forming a gel-like substance 27. In FIG. 6, the formation of the gel will act as a seal so that it will plug the crack 25, thereby causing a part of liquid 22 to be retained in its liquid form within container 20. If the container 20 broke to a greater extent, that is, more than a crack, so that all of the liquid 22 tended to flow therefrom, the entire amount of liquid would be formed into a gel-like substance, such as 27, provided that the outer container 19 could retain the liquid therein for a sufficient time for the envelope 11 to degrade and for the solidification to occur. In this respect, it is preferable that the outer container 19 be sufficiently leak-resistant so that the foregoing could occur.

It will be appreciated that the amount of material 12 which is required within envelope 11 for any particular situation will depend on the volume of inner container 20, that is, envelope 11 should contain enough material 12 to completely absorb and immobilize the entire amount of liquid.

While the material of envelope 11 has been shown as including a coating 17 on its entire surface, it will be appreciated that in certain circumstances this coating for effecting heat-sealing need be applied to only select portions of the material 15 which are to be sealed to each other. Furthermore, while the coating 17 has been described as polyvinyl acetate, it will be appreciated that it can comprise any other material which lends itself to heat-sealing or to other types of sealing during the formation of envelope 11. It is further contemplated that the degradable envelope 11 need not be a material which is completely or partially coated, but may be an uncoated material from which the envelope is formed by stitching or other means of fabrication.

While the present disclosure has been directed specially to an absorbing and immobilizing material which reacts with aqueous solutions, it will be appreciated that the principles of the present invention include the use of absorbing and immobilizing materials which operate with other liquids and the envelope may comprise other materials which will degrade in such other solutions.

While a specific example has been shown in FIGS. 5 and 6, it will be appreciated that packets, such as 10, may be placed in contiguous relationship to a liquid-containing container which may not be enclosed within an outer container, to absorb and immobilize leaks therefrom, provided that leaking liquid can be restrained for a sufficient time for solidification to occur.

An actual packet has been fabricated containing 1.5 grams of sodium polyacrylate with the envelope being fabricated of starch paper having a weight of 45 grams per square meter and with the polyvinyl acetate being coated to a depth of 1.5 mils. The preferred size of the foregoing envelope 11 is 1¼ inches times 2 inches.

While preferred embodiments of the present invention have been disclosed, it will be appreciated that it is not limited thereto but may be otherwise embodied within the scope of the following claims.

What is claimed is:

1. A packet for absorbing and immobilizing a relatively large amount of liquid comprising a degradable envelope which is degradable in said liquid, and a relatively small mount of liquid absorbing and immobilizing material means in said envelope for immobilizing said liquid by forming a gel-like substance on absorbing said relatively large amount of liquid after said degradable envelope degrades after being contacted by said liquid.

2. A packet as set forth in claim 1 wherein said liquid includes water and wherein said liquid absorbing and immobilizing material means is sodium polyacrylate.

3. A packet as set forth in claim 1 wherein said envelope includes a layer of starch paper with a coating of polyvinyl acetate.

4. A packet as set forth in claim 1 wherein said envelope includes a layer of material which is degradable in said liquid, and a coating of material on said layer of material which permits said layer of material to be sealed in the form of said envelope.

5. In an outer container having an inner container with a relatively large amount of liquid from which said liquid can leak, an absorbent packet located between said inner and outer containers for absorbing and immobilizing said relatively large amount of liquid within said outer container in the event of leakage of said relatively large amount of liquid from said inner container comprising a degradable envelope which is degradable in said liquid, and a relatively small amount of liquid absorbing and immobilizing material means in said envelope for immobilizing said liquid by forming gel-like substance on absorbing said relatively large amount of liquid after said degradable envelope degrades after being contacted by said liquid.

6. In an outer container having an inner container with liquid from which said liquid can leak as set forth in claim 5 wherein said envelope includes an outer layer of material which is degradable in said liquid and a sealing coating on the inner surface of said outer layer of material.

7. In an outer container having an inner container with liquid from which said liquid can leak as set forth in claim 5 wherein said envelope includes a layer of material which is degradable in said liquid, and a coating of material on said layer of material which permits said layer to be sealed in the form of said envelope.

8. In an outer container having an inner container with liquid from which said liquid can leak as set forth in claim 7 wherein said layer of material comprises starch paper, and wherein said coating of material comprises polyvinyl acetate.

9. In an outer container having an inner container with liquid from which said liquid can leak as set forth in claim 5 wherein said absorbing and immobilizing material means is sodium polyacrylate.

10. In an outer container having an inner container with liquid from which said liquid can leak as set forth in claim 9 wherein said envelope includes a layer of material which is degradable in said liquid, and a coating of material on said layer of material which permits said layer to be sealed in the form of said envelope.

11. In an outer container having an inner container with liquid from which said liquid can leak as set forth in claim 10 wherein said coating of material is on the entire surface of said layer of material.

12. In an outer container having an inner container with liquid from which said liquid can leak as set forth in claim 11 wherein said layer of material comprises starch paper, and wherein said coating comprises polyvinyl acetate.

13. A packet for absorbing and immobilizing a liquid comprising a degradable envelope which is degradable in said liquid, and a first volume of liquid absorbing and immobilizing material means in said degradable envelope for absorbing and immobilizing a much larger second volume of said liquid after said degradable envelope degrades after contact with said liquid.

14. A packet as set forth in claim 13 wherein said degradable envelope includes a layer of degradable paper, and a sealing coating on said layer of degradable paper which permits said layer of degradable papers to be sealed in the form of an envelope.

15. In an outer container having an inner container with liquid from which said liquid can leak, an absorbent packet located between said inner and outer containers for absorbing and immobilizing said liquid within said outer container in the event of leakage of said liquid from said inner container comprising a degradable envelope which is degradable in said liquid, and a first volume of liquid absorbing and immobilizing material means in said envelope for absorbing and immobilizing a much larger second volume of said liquid after said degradable envelope degrades after being contacted by said liquid.

16. A packet for absorbing and immobilizing a liquid comprising an envelope which is degradable in said liquid, and a liquid absorbing and immobilizing material in said envelope for absorbing and immobilizing said liquid after said degradable envelope degrades after being contacted by said liquid.

17. In an outer container having an inner container with liquid from which said liquid can leak, an absorbent packet located between said inner and outer containers for absorbing and immobilizing said liquid within said outer container in the event of leakage of said liquid from said inner container comprising a degradable envelope which is degradable in said liquid, and a liquid absorbing and immobilizing material in said envelope for absorbing and immobilizing said liquid after said degradable envelope degrades after being contacted by said liquid.

* * * * *

UNITED STATES PATENT AND TRADEMARK OFFICE

CERTIFICATE OF CORRECTION

PATENT NO. : 4,749,600

DATED : June 7, 1988

INVENTOR(S) : John S. Cullen et al

It is certified that error appears in the above-identified patent and that said Letters Patent is hereby corrected as shown below:

Column 4, line 9 (claim 5), before "gel-like" insert --a--.

Column 4, line 24 (claim 7), after "layer" insert --of material--

Column 4, line 39 (claim 10), after "layer" insert --of material--.

Column 4, line 59 (claim 14), change "papers" to --paper--.

Signed and Sealed this

Twenty-fifth Day of October, 1988

*Attest:*

DONALD J. QUIGG

*Attesting Officer*

*Commissioner of Patents and Trademarks*